United States Patent [19]

Ludvik

[11] 4,093,200

[45] June 6, 1978

[54] DEVICE FOR CUTTING YARN

[76] Inventor: George F. Ludvik, 9113 Rockefeller La., Springfield, Va. 22153

[21] Appl. No.: 728,560

[22] Filed: Oct. 1, 1976

[51] Int. Cl.[2] ..... B25B 5/14

[52] U.S. Cl. ..... 269/295

[58] Field of Search ..... 269/293, 294, 295, 58, 269/321 W, 254 R; 242/56 R, 68.5

[56] References Cited

U.S. PATENT DOCUMENTS

| | | | |
|---|---|---|---|
| 707,294 | 8/1902 | Blackhall | 269/293 |
| 1,509,621 | 9/1924 | Tompkins | 242/56 R |
| 2,283,626 | 5/1942 | Freydberg | 269/293 |
| 2,659,543 | 11/1953 | Guyer | 242/68.5 |
| 3,933,154 | 1/1976 | Cabansag | 269/328 |

*Primary Examiner*—Robert C. Watson

[57] ABSTRACT

Device for cutting yarn which comprises a drum having a plurality of narrow grooves in the outer surface, means for holding the yarn in place on the outer surface of the drum and base support means for holding the drum.

9 Claims, 4 Drawing Figures

Fig. 1
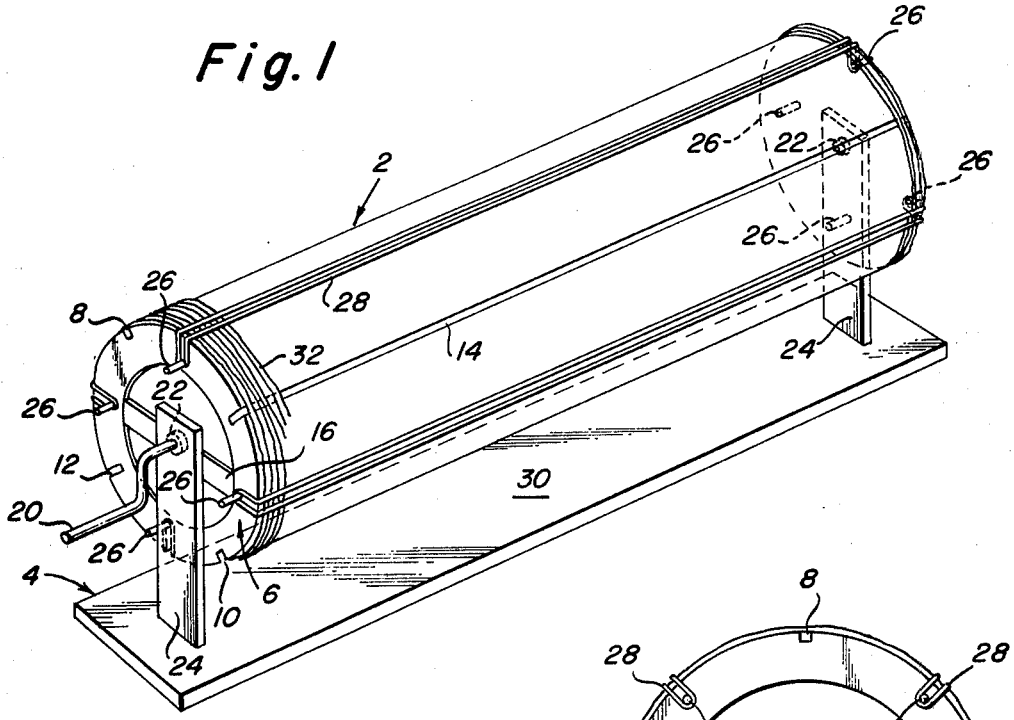
Fig. 2
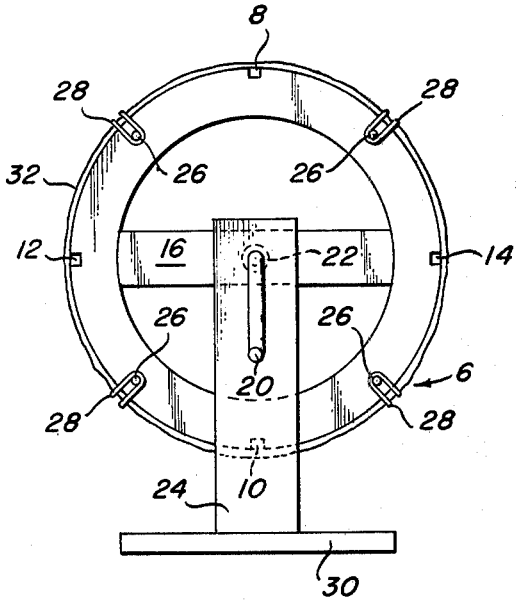
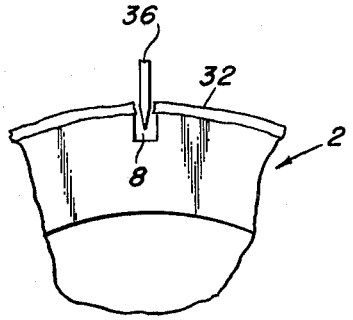
Fig. 3
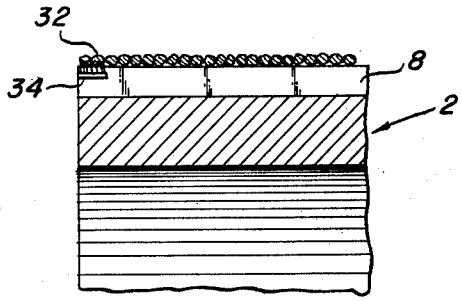
Fig. 4

DEVICE FOR CUTTING YARN

This invention relates to the needlecraft art, and more particularly to the art of making rugs, wall hangings, pillows and the like utilizing the latchet hook technique.

In the making of rugs and the like those skilled in the art will appreciate the utility of a device with which yarn can be cut rapidly and simply to appropriate length with clean-cut, unfrayed ends and without untwisting and tangling the yarn. They will also appreciate the freedom, 1) from dependence upon expensive, small-package, pre-cut yarns, and 2) to select a broad range of natural and synthetic yarns for craft projects not otherwise available as conventional, pre-cut items.

My invention relates, more particularly, to a device for receiving and holding yarn whereby short sections of yarn, natural or synthetic, may be easily and readily cut for use by a craftsperson who is hooking a rug or the like using the latchet-hook technique. It is the purpose of my invention to provide to a craftsperson an inexpensive device for easily and readily preparing large numbers of uniform, untangled and clean-cut sections of yarn for use in the latchet-hooking of rugs, and the like.

Briefly, the device of my invention comprises a drum having a plurality of narrow grooves in the outer surface thereof which are adapted to receive and serve as a guide for a sharp cutting instrument suitable for cutting yarn such as scissors, means for holding the yarn in place on the surface of the drum, and base support means for holding the drum. In greater detail, the drum is a cylinderical core or tube-like body into the outer surface of which are incised a plurality of axially aligned, uniformly spaced grooves. The yarn is wound helically and uniformly about the drum. When the drum is wound full, the yarn is secured by placing a plurality of holding means over it. The holding means, which may be an elastic band, is placed parallel to and midway between each pair of grooves and is removably secured at one end or both ends of the drum. The holding means maintains the yarn in position during the cutting of the yarn so as to retain the severed yarn pieces on the drum and to insure that pieces of uniform length will be obtained. The first cut is made by inserting the pointed blade of a sharp pair of scissors in the end of a groove and cutting the yarn along the length of that groove. The drum is then rotated 180° and a second cut made along a second groove which is opposite the first groove. Ideally, yarn should be wound on the drum without tension, but inevitably some minimal tension will be applied. The need to relieve such tension as uniformly as possible is important in order to obtain yarn pieces of uniform length with clean-cut ends and which is the reason for making successive cuts along grooves on opposite faces of the drum, which is also the reason for having grooves in pairs which are diametrically opposed. All subsequent cuts are made along grooves half-way between previously used grooves. Basically, a drum of uniform circumference having two diametrically opposed grooves would suffice, and would fall within the scope of this invention. However, ease of production of yarn pieces is increased in proportion to the increased circumference of the drum and as the number of grooves is increased. The number of grooves in the drum is a function of $2^n$ wherein $n$ is an integer of one to four, and thus, the number of grooves is, two, four, eight or sixteen. Most frequently, the number of grooves is four or eight, which is appropriate for a device of a size convenient for the use of the home craftsperson. The drum is mounted on a base support means which allows for rotation of the drum. The drum may be removably mounted on the base support means or may be mounted without provision for removal.

I have thus described my invention generally in order that its operation and utility may be better understood by those skilled in the art. While I shall illustrate below a preferred embodiment of my invention, it should be understood that my basic contribution may be utilized in other physical forms. Moreover, while I have for convenience described my invention as relating to the needlecraft art, and particularly to the latchet hooking art, it is readily understandable that my contribution may be useful in other arts, and I therefore do not wish the scope thereof to be limited to the preparation of yarn lengths for the latchet hooking art.

Referring now to the drawing,

FIG. 1 is a perspective view of my device for cutting yarn.

FIG. 2 shows an end view of my device.

FIG. 3 is a partial cross-section showing a cutting instrument in position for cutting the yarn.

FIG. 4 is a cross-section along the axis of the drum showing the yarn in place.

Referring now even more particularly to the drawing, reference numeral 2 designates the drum, numeral 4 designates the base support means, and numeral 6 designates the holding means. In the embodiment shown in the Figures, the drum 2 is a wound and glued paperboard cylinder or core with two pairs of diametrically opposed grooves 8 and 10 and 12 and 14 incised axially in the outer surface with sufficient depth and shape to receive the cutting edge of a pair of scissors or the like. The drum may be formed from metal such as aluminum or plastic such as a polypropylene, polystyrene or polyvinyl chloride, or turned from wood and be quite as effective as in its preferred form. The outer surface of the drum can be provided with a very slightly roughened surface to aid in winding the yarn.

The distances between the centers of each of the grooves 8, 10, 12 and 14 are all 2.5 inches, the standard length for pieces of yarn as commonly used for latch hooking, and the circumference of the drum is therefore 10 inches. Flexibility in rug design and execution can be obtained by providing drums with larger or smaller circumferences, longer or shorter distances between the grooves and varying pairs of grooves. The depth and width of the grooves 8, 10, 12, and 14 may be variable but must be large enough to accept the pointed blade of the cutting instrument but yet small enough to insure that the yarn will be cut in even lengths. In the embodiment shown, grooves $\frac{1}{8}$ inch wide and $\frac{1}{8}$ inch deep are provided, which cooperate well with scissors of average size. The drum 2 can be of varying length; however, a length of about $8\frac{1}{2}$ inches is convenient for ease of handling. One or more radial struts 16 are secured flush with each end of the drum 2. These struts may be of variable composition and design but in the embodiment shown they are wood. An axle 18 is provided axially with respect to the drum and secured to the struts 16 so that the drum rotates on turning the crank 20 which, as shown, may be an integral part of the axle. The axle 18 may be of variable composition but in the embodiment shown is a round metal rod. The crank 20 could be replaced by any suitable axle-turning device such as a wooden or plastic wheel or knob firmly affixed to the axle 18 of appropriate size. A washer or bushing 22 is inserted over each end of the axle 18 and between the struts 16 and upright supports 24. The washers or bushings 22 must be sufficiently thick to permit the holding pins 26 to clear the supports 24 when the drum is rotated. Items known as ½ inch wooden macrame beads have been found to be eminently satisfactory. The pins 26 are mounted equidistant between adjacent grooves in each end of the drum 2. Each pin protrudes ¼ inch from each end surface of the drum. The elastic band retaining means 26 may be of variable design. Items known in the hardware art as No. 18, 1 inch wire brads are suitable. The holding means 6 for retaining the yarn on the drum, in the embodiment shown, is completed by use of an elastic member 28 which is stretched with very moderate tension axially along the drum by removable attachment to a pair of pins 26. The base support means, in the embodiment shown, FIGS. 1 and 2, includes a flat base 30 and upright support member 24 which is adapted to rotatably receive the axle 18. The support means in another embodiment can have a notch in the top part of the upright support member 24 — to in effect cradle the axle and thus provide for ready removal of the drum.

In the operation of my yarn cutting device, the yarn 32 is wound around the drum 2 by securing the loose end of the yarn in a notch or other catch means such as Velcro ® stick tape 34 embedded at one end of the drum and turning the drum by means of crank 20 while applying only mild tension on the yarn.

Once the yarn 32 has been wound fully about the drum 2, it is retained in place for cutting by emplacement of yarn holding means 26 and 28. The elastic yarn holding member 28 can be of various designs and materials, but in the embodiment shown is a rubber band, with those of 2½ inch length being eminently satisfactory for a drum of 8½ inch length. When secured in the manner described, the yarn 32 is ready for cutting. Cutting is accomplished by following with a suitable cutting instrument 36 along the entire length of say, groove 8. This operation is repeated serially next along groove 10, then groove 12, and finally along groove 14, or in other words, first cutting the yarn to a length equivalent to that of one revolution, next cutting that length in half, and then cutting each of these halves in half. Cutting instruments of various types and designs could be employed, but the most satisfactory has proved to be a sharp scissors with one pointed blade tip which enhances following along the several grooves.

The yarn pieces are made available for use by releasing the several elastic members 28 in turn and manually removing the cut yarn from the drum.

From the foregoing, it is believed that those familiar with this art will readily recognize and appreciate the novel features and advantages of the present invention which marks it apart from and as a novel advancement over previously known devices for producing yarn pieces in this art. Also, it is to be understood that while the features of the present invention have been described and illustrated in relation to a particular embodiment thereof as set forth in the accompanying drawings, nevertheless numerous changes, modifications, and substitutions of equivalents may be made therein without departing from the spirit and scope of its inventive features.

What I claim is:

1. A device for cutting elongated material which comprises a drum having a plurality of axially disposed uniformly and equidistantly spaced, narrow grooves; said grooves being at least four in number; said material being disposed on said drum's surface, means for securing the material thereon, and comprising elastic band means mounted at opposite ends of the drum and spaced equidistant between adjacent grooves; base support means for rotatably supporting the drum, and including a pair of upright members rotatably receiving the drum, and said grooves being selected that when the material is cut by cutting means placed in selected ones of said grooves the material will be substantially equal in length.

2. The device according to claim 1 wherein said drum in removably mounted on said base support means.

3. The device of claim 1 further including a shaft centrally disposed within the drum, means on the ends of the drum connected to the shaft, and handle means secured to the shaft for rotating the same with respect to the base support beams.

4. The device of claim 3 wherein the shaft is supported on the base support means.

5. The device of claim 3 wherein the means on the ends of the drums are radial struts and bushings are disposed at the inner ends with said shaft extending therethrough.

6. The device of claim 3 wherein pin means extend outwardly from each end of the drum and elastic means removably connected thereto for holding the yarn to be cut in place.

7. The device of claim 6 wherein yarn engaging means are secured on the drum for maintaining one end of the yarn thereon.

8. The device of claim 7 wherein the yarn engaging means is Velcro. ® TM

9. The device of claim 6 wherein the pin means are equidistantally disposed between the grooves.

* * * * *